United States Patent [19]

Michiue et al.

[11] Patent Number: 4,670,375

[45] Date of Patent: Jun. 2, 1987

[54] LIGHT-SENSITIVE SILVER HALIDE COLOR PHOTOGRAPHIC MATERIAL HAVING EXTENDED EXPOSURE RANGE AND IMPROVED GRAININESS AND STABILITY TO PROCESSING AND TIME

[75] Inventors: Kenji Michiue; Toshihiko Yagi; Katsumasa Yamazaki; Sohei Goto; Yoshiharu Mochizuki, all of Hino, Japan

[73] Assignee: Konishiroku Photo Industry Co., Ltd., Tokyo, Japan

[21] Appl. No.: 775,641

[22] Filed: Sep. 13, 1985

[30] Foreign Application Priority Data

Sep. 20, 1984 [JP] Japan ..... 59-198129

[51] Int. Cl.[4] ..... G03C 1/02; G03C 1/46; G03C 1/08

[52] U.S. Cl. ..... 430/509; 430/506; 430/543; 430/567; 430/569; 430/940

[58] Field of Search ..... 430/506, 509, 567, 569, 430/940, 543

[56] References Cited

U.S. PATENT DOCUMENTS 4,184,877 1/1980 Maternaghan ..... 430/569 X
4,444,877 4/1984 Koitabashi et al. ..... 430/567
4,461,826 7/1984 Yamashita et al. ..... 430/567 X

FOREIGN PATENT DOCUMENTS 0070181 1/1983 European Pat. Off. .
0096873 12/1983 European Pat. Off. .
1027146 4/1966 United Kingdom .

*Primary Examiner*—John E. Kittle
*Assistant Examiner*—Mukund J. Sham
*Attorney, Agent, or Firm*—Frishauf, Holtz, Goodman & Woodward

[57] ABSTRACT

Disclosed is a light-sensitive silver halide color photographic material comprising a support and a plurality of silver halide emulsion layers on the support, the emulsion layers being substantially identical in color sensitivity but different in sensitivity and containing at least one of a dye image-forming coupler, characterized in that silver halide grains contained in at least one layer of the plurality of silver halide emulsion layers consist substantially of monodispersed silver halide grains, a color concentration of the emulsion layer comprising the monodispersed silver halide grains being within the range of 60 to 98% of the total color concentration of the plurality of silver halide emulsion layers.

The employment of the monodispersed silver halide grains of this invention and the increase in a concentration of the grains in the emulsion layers permit the improvement of graininess, the enlargment of exposure range and better of stability to processing and stability with time.

14 Claims, No Drawings

LIGHT-SENSITIVE SILVER HALIDE COLOR PHOTOGRAPHIC MATERIAL HAVING EXTENDED EXPOSURE RANGE AND IMPROVED GRAININESS AND STABILITY TO PROCESSING AND TIME

BACKGROUND OF THE INVENTION

This invention relates to a light-sensitive silver halide color photographic material, and more specifically to a light-sensitive silver halide color photographic material having an extended exposure range and excellent in graininess, stability to processing and stability with time.

With regard to a light-sensitive silver halide color photographic material (hereinafter referred to as the light-sensitive material), various improvements in performance have heretofore been required, but in recent years, a higher sensitization is needed and the miniaturization of an image plane size of the light-sensitive material is particularly required along with the miniaturization of cameras. For these reasons, technical developments of a higher image quality (in particular, graininess) of the light-sensitive materials are now strongly demanded. As the most effective technique for improving in the graininess, it has been suggested to use a monodispersed silver halide emulsion, as described in Japanese Provisional Patent Publications No. 28743/1983, No. 14829/1983 and No. 100847/1983. These methods, however, have the drawback that an exposure range cannot be enlarged.

On the other hand, in order to improve the exposure range, there have been suggested, for example, (1) a light-sensitive material in which in silver halide emulsion layers having blue, green and red color sensitivities, the same color sensitive silver halide emulsion layer is composed of a plurality of layers having different sensitivities, for example, 2 or 3 layers, (2) a light-sensitive material in which the silver halide emulsion layer contains at least two kinds of silver halide grains having different average grain diameters from each other, (3) a light-sensitive material in which several kinds of monodispersed silver halide grains that are different in a surface iodine composition are used, as disclosed in Japanese Patent Publication No. 4332/1983, and the like. The present inventors have suggested in Japanese Patent Application No. 17955/1984 a technique of simultaneously using monodispersed core/shell emulsion grains each having a large average grain diameter with iodine concentration in the core being high, and other monodispersed core/shell emulsion grains each having a small average grain diameter with iodine concentration in the core being low. However, it has been found that while this technique permits extending the exposure range, but the improvement of the graininess is insufficient, because improvements of the exposure range and of graininess are mutually contradictory to each other.

SUMMARY OF THE INVENTION

An object of this invention is to provide a light-sensitive silver halide color photographic material which is excellent in graininess, stability to processing and stability with time and in which an exposure range has been enlarged.

The above-mentioned object can be accomplished by a light-sensitive silver halide color photographic material comprising a support and a plurality of silver halide emulsion layers on said support, the emulsion layers being substantially identical in color sensitivity but different in sensitivity and containing at least one of a dye image-forming coupler, characterized in that silver halide grains contained in at least one layer of the plurality of silver halide emulsion layers consist substantially of monodispersed silver halide grains, and a color concentration of the emulsion layer comprising the monodispersed silver halide grains being within the range of 60 to 98 % of the total color concentration of the plurality of silver halide emulsion layers.

DESCRIPTION OF THE PREFERRED EMBODIMENTS

Now, this invention will be concretely described in detail.

In the light-sensitive material of this invention, light-sensitive layers substantially identical in color sensitivity and containing a dye image-forming coupler comprise a plurality of silver halide emulsion layers (hereinafter referred to as the emulsion layers) having a different sensitivity from each other are employed. In this invention, the above-mentioned expression "substantially identical in a color sensitivity" means that if the light-sensitive layers have a color sensitivity in a spectrum wavelength region in which usual multi-layer light-sensitive materials are sensitive to light, for example, in any wavelength region of blue, green and red regions, they are regarded as substantially identical with each other in a color sensitivity, even though they are slightly different from each other in a light-sensitive region at a certain wavelength.

In this invention, the monodispersed silver halide grains mean grains in which the weight of the silver halide grains each having an average diameter $\bar{r}$ and diameters within the range of ±20 % of the average diameter $\bar{r}$ occupies 60 % or more of the total weight of the silver halide grains. The above-mentioned average diameter $\bar{r}$ can be defined as a grain diameter $r_i$ (significant figure =3 figures) at the time when a product $n_i \times r_i^3$ of a frequency $n_i$ of the grains each having the grain diameter $r_i$ and $r_i^3$ is at a maximum level.

The grain diameter referred to herein means a diameter of each grain when the silver halide grain is spherical, and a diameter obtained by converting a projected image of each grain into a circular image having the same area when it is not spherical. The grain diameter can be determined, for example, by enlarging each grain 10,000-fold to 50,000-fold with the aid of an electron microscope, photographing it, and measuring a diameter of the grain or an area of its projected image on the resultant print. The grains to be measured are selected at random as many as 1,000 or more.

The above-mentioned passage "consist substantially", that is, essentially"of monodispersed silver halide grains" means that the silver halide emulsion of the grains having different diameters can be used in mixture subject to not impairing the effect of monodispersed properties and that the grains have a grain diameter distribution curve which has a plurality of modes which can be included in this invention. With regard to a grain diameter distribution of the silver halide grains comprising the substantially monodispersed silver halide grains inclusive of such grains as mentioned above, the weight of the silver halide grains having the diameter of the above defined $\bar{r}$ and the diameters within the range of ±20 % of the diameter $\bar{r}$ occupies 70 % or more, preferably 80 % or more, particularly preferably 90 % or more, of the total weight of the grains. The monodispersed silver halide grain of this invention preferably is a so-called core/shell type grain comprising two or more layers (i.e. zones) with a different silver iodide content, and an iodine content in the core within the range of 6 to 30 mole %. The average diameter of the silver halide grain is preferably from 0.2 to 3 μm, more preferably from 0.3 to 0.7 μm. A silver iodide content in the shell is preferably from 0 to 6 mole %. A transition of the silver iodide content from the core to the shell may be bounded sharply, but the silver iodide content preferably varies continuously and gradually instead of a sharp variation. The continuous and gradual variation permits controlling a photographic development. Further, the core and shell may contain 10 mole % or less of silver chloride, but preferably contains no silver chloride.

The silver halide grain comprising the substantially monodispersed silver halide grain of this invention (hereinafter referred to as the monodispersed silver halide grain of this invention) may be of normal crystal or twinned crystal, and it may take any shape of hexahedron, octahedron, tetradecahedron, plate or sphere, or may be in a combination of these shapes, but the preferable grains have the normal crystals of hexahedron, octahedron and tetradecahedron as well as the twinned crystals. In particular, it is preferred to use the normal crystal grains of octahedron or tetradecahedron or twinned crystal grains alone.

The monodispersed silver halide grains of this invention can be manufactured by means of a double jet method while the pAg is constantly maintained, and in this case, the grains each having a desired size can be prepared. In order to prepare the highly monodispersed silver halide grains, a method disclosed in Japanese Provisional Patent Publication No. 48521/1979 may be employed. For example, there may be manufactured by adding an aqueous potassium iodobromide-gelatin solution and an aqueous ammoniacal silver nitrate solution to an aqueous gelatin solution containing silver halide seed grains, while their addition rates are varied as functions of time. In this way, the highly monodispersed silver halide grains can be prepared by suitably selecting an addition rate, pH, pAg, temperature and the like.

The twin monodispersed grains of this invention can be prepared in accordance with methods disclosed in specifications of Japanese Provisional Patent Publication No. 39027/1976, No. 88017/1976, No. 153428/1977, No. 118823/1979, No. 142329/1979 and the like.

Further, the highly monodispersed twin emulsion can be prepared by physically ripening nuclear grains comprising silver iodobromide multiple twinned crystals, the silver iodide content of which is 5 mole % or less, in the presence of a silver halide solvent in order to prepare seed units each comprising monodispersed spheres, and then adding a water soluble silver salt and a water soluble halide thereto in order to cause the seeds to grow. In this connection, if a tetrazaindene compound is present at the growing period of the twin emulsion, the improvement in the monodispersed properties can be expected.

In the core-shell type grains, the monodispersed silver halide grains prepared in the above-mentioned manner are employed as the cores, and for example, a soluble halide compound and a soluble silver salt solution are used in accordance with the double jet method to deposit shells on the cores, thereby forming the monodispersed core/shell silver halide grains.

The monodispersed silver halide grains of this invention preferably are such core/shell type grains as mentioned above, but in the core/shell type grains, a thickness of each shell is preferably within the range of 0.01 to 0.15 μm. When an average thickness of the shell is less than 0.01 μm, a photographic performance will be about the same as in the case of using the grains without shells, but when the thickness of each shell lies within the above indicated range, its graininess will be better than in the case in which it is less than 0.01 μm, and the effect of this invention will be greater than in the case in which it is more than 0.15 μm.

Methods for preparing the above-mentioned core/shell type silver halide grains are disclosed, for example, in West German Patent No. 1,169,290, British Patent No. 1,027,146 and Japanese Provisional Patent Publication No. 154232/1982 and Japanese Patent Publication No. 1417/1976.

In a process for manufacturing the monodispersed silver halide grains of this invention, there may coexist, for example, a cadmium salt, a zinc salt, a lead salt, a thallium salt, an iridium salt or a complex salt thereof, a rhodium salt or its complex salt.

The monodispersed silver halide grains of this invention constitute a silver halide emulsion together with a hydrophilic colloid binder (e.g., gelatin) and the like which are usually used in the art.

The aforesaid emulsion layer including the monodispersed silver halide grains of this invention and having a color concentration of 60 to 98 % (hereinafter referred to as the silver halide emulsion layer of this invention) may take a morphology of a single layer or an emulsion layer unit comprising the two or more layers. In the latter case, a combined plurality of layers is the silver halide emulsion layers of this invention when said plurality of layers in total constituting the emulsion layer units satisfy the requirements of the silver halide emulsion layers of this invention.

If the silver halide emulsion layers of this invention are applied to a usual multi-layer light-sensitive material having a blue-sensitive emulsion layer, a green-sensitive emulsion layer and a red-sensitive emulsion layer, it suffices to apply the emulsion layer to at least one layer of them. Further, when an emulsion layer having a certain color sensitivity comprises a plurality of layers (e.g., 2 or 3 layers) sensitivities of which are different, the silver halide emulsion layers of this invention may be applied to one or more layers thereof.

In such constitutions, the silver halide emulsion layer of this invention may be applied to any layer having a certain color sensitivity with a different photographic sensitivity, but it is advantageous for the enlargement of an exposure range that the emulsion layer of this invention is applied to a lower-sensitivity layer in the case of two emulsion layers having a certain color sensitivity with a different photographic sensitivity, and to a medium-sensitivity layer and/or a lower-sensitivity layer in the case of three layers, instead of its application to a higher sensitivity layer. In such a case, for example, if a combination of the medium-sensitivity layer and the lower-sensitive layer comprises the silver halide emulsion layer of this invention, it can also be included in the scope of this invention. With regard to the emulsion layers other than the silver halide emulsion layers of this invention, the silver halide grains may be monodispersed or polydispersed and may be of normal crystal or twinned crystal, but the silver halide grains in the most sensitive emulsion layer preferably are twinned crystal in view of development properties toward the lower layers, as well as monodispersibilities and preservability. Furthermore, a non-light-sensitive hydrophilic colloidal layer (e.g., a gelatin layer) may be interposed between the layer having the highest sensitivity and the just lower emulsion layer (as seen from an exposuring position), but it is more advantageous in view of an interlayer effect that the colloidal layer include no silver halide grains.

In the case in which the light-sensitive photographic material of this invention has a blue-sensitive emulsion layer, a green-sensitive emulsion layer and a red-sensitive emulsion layer, it suffices that the silver halide emulsion layer of this invention be applied to at least one layer of these emulsion layers, but when the layers of this invention are applied to the two layers having different color sensitivities, the effects of this invention become greater, and when the layers of this invention are applied to all of the three layers having different color sensitivities, the greater effects can be expected with regard to stability to processing and stability with time.

A preferable constitution of this invention is when the light-sensitive photographic material is the multi-layer color photographic material comprising two or more emulsion layers having substantially the same color sensitivity and different photographic sensitivity; the silver halide emulsion layer of this invention is applied to the layer other than the higher sensitivity layer of the color-sensitive layers; and a color concentration in the highest sensitivity layer is within the range of 2 to 40 %, more preferably, 2 to 30 %, of the total color concentration of the layers having the same color sensitivity. In such an aspect, the effects of this invention will be particularly remarkable.

Moreover, the color concentration in the silver halide emulsion layers of this invention is within the range of 60 to 98 %, preferably 70 to 95 %, more preferably 80 to 90 % of the total concentration in the same color-sensitive layers.

As to the manner for controlling the color concentration, any methods well known for a man skilled in the art can be applied. That is, the color concentration can be controlled in the range of the present invention by controlling (1) an amount of silver to be coated of a silver halide, (2) a halogen composition of a silver halide emulsion, (3) a grain diameter of a silver halide grain, (4) an amount of a coupler to be coated, (5) an amount of DIR compound to be added, and the like.

Color concentration methods (1) to (5) can be explained in more detail. The amount of silver to be coated of a silver halide is preferable in the range of 3 to 40 mg/dm$^2$, particularly preferably 5 to 25 mg/dm$^2$. Further, as to the halogen composition of a silver halide, it is preferred to use a silver iodobromide having an average silver iodide content of 3 to 15 mole %, and particularly preferred is a silver iodobromide containing 5 to 12 mole % of silver iodide. As to the average grain diameter of a silver halide grain, it is preferred to use a silver halide grain having an average grain diameter of 0.2 to 3.0 μm, particularly preferably 0.3 to 0.7 μm. The amount of a coupler to be coated is preferably $1\times10^{-3}$ to $1\times10^{-7}$ mole/dm$^2$, more preferably $1\times10^{-4}$ to $1\times10^{-6}$ mole/dm$^2$. As to the amount of a DIR compound to be added, it is preferred to use the DIR compound within the range of 0.0001 to 0.01 mole per mole of silver halide.

The color concentration referred to herein means a maximum color concentration which the layers have when subjected to exposure and development described hereinafter. A light source for the exposure can be adjusted by the use of a filter so that a maximum color concentration may be obtained in a wavelength region in accord with the color properties of the emulsion layers. The color concentration can be measured by the use of a densitometer (a Status M filter is used) made by Macbeth Co., Ltd.

| Developing Processing Step (38° C.) | Processing Time |
|---|---|
| Color Development | 3 min. 15 sec. |
| Bleach | 6 min. 30 sec. |
| Washing | 3 min. 15 sec. |
| Fixing | 6 min. 30 sec. |
| Washing | 3 min. 15 sec. |
| Stabilization | 1 min. 30 sec. |

Compositions of the processing solutions used in the respective processing steps are as follow:

Composition of a color developing solution:

| | |
|---|---|
| 4-Amino-3-methyl-N—ethyl-N—(β-hydroxyethyl)-aniline sulfate | 4.8 g |
| Anhydrous sodium sulfite | 0.14 g |
| Hydroxylamine ½ sulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |

made up to one liter with addition of water.

Composition of a bleaching solution:

| | |
|---|---|
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |

made up to one liter with addition of water and adjusted to pH 6.0 by use of aqueous ammonia.

Composition of a fixing solution:

| | |
|---|---|
| Ammonium thiosulfate | 175.0 g |
| Anhydrous sodium sulfite | 8.6 g |
| Sodium metasulfite | 2.3 g |

made up to one liter with addition of water and adjusted to pH 6.0 by use of acetic ammonia.

Composition of a stabilizing solution:

| | |
|---|---|
| Formalin (37% aqueous solution) | 1.5 ml |
| 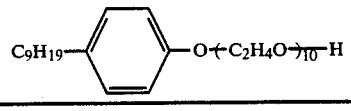 | 1.0 ml |

made up to one liter with addition of water.

It is preferred that such DIR compounds (hereinafter referred to as non-diffusible DIR compounds) as will be enumerated in the following are added to the silver halide emulsion layers of this invention with the intention of improving a graininess and extending an exposure section:
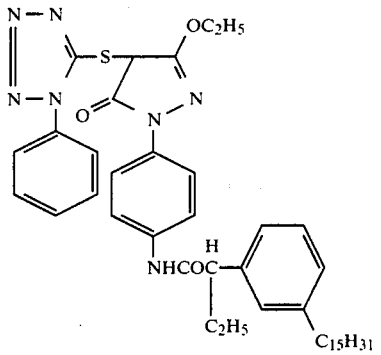
(I-1)
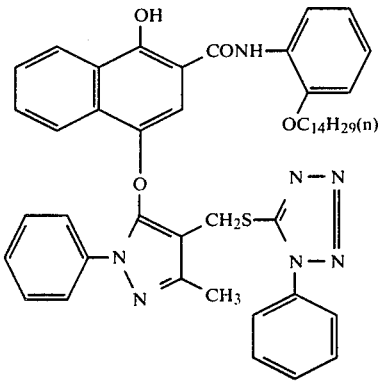
(I-2)
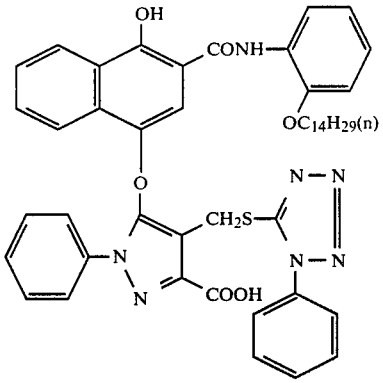
(I-3)
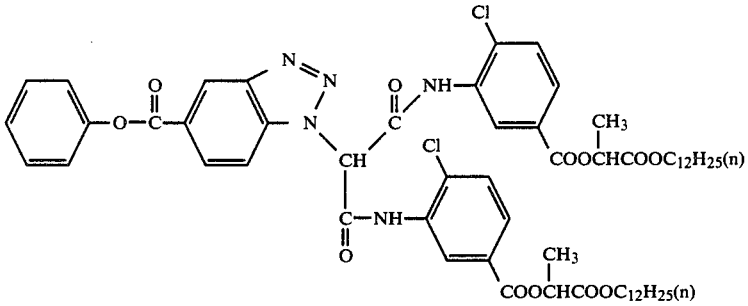
(I-4)
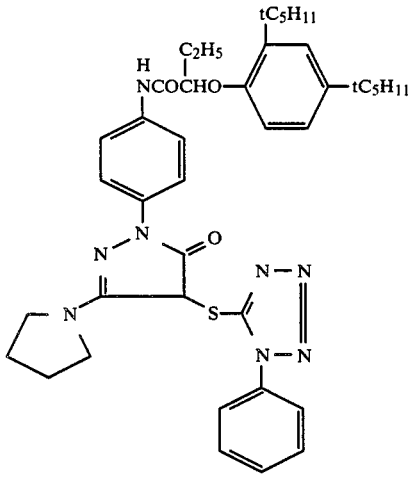
(I-5)
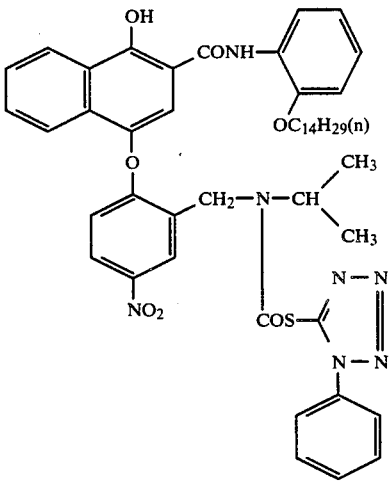
(I-6)

-continued
(I-7)
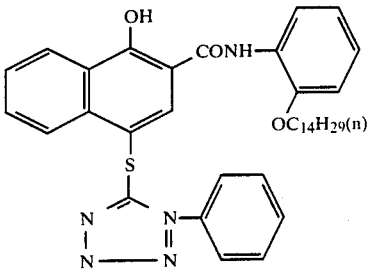
(I-8)
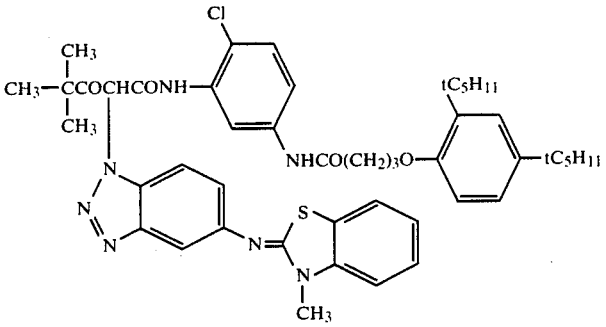
(I-9)
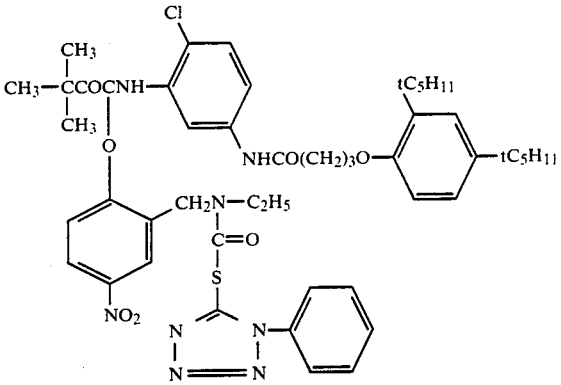
(I-10)
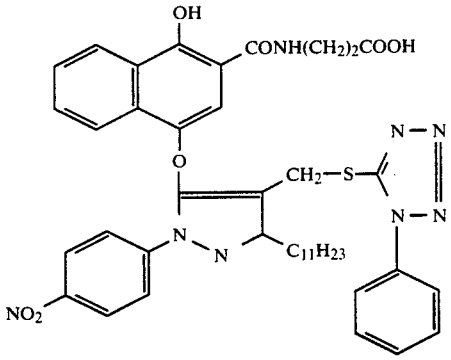
(I-11)
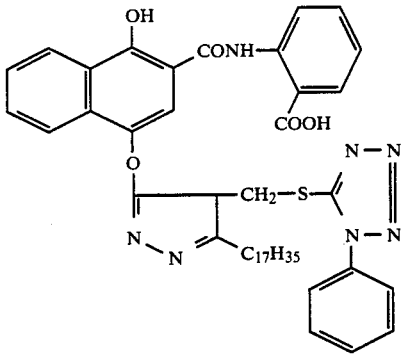
(I-12)
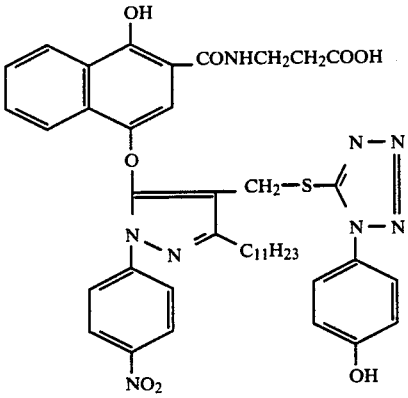
(I-13)
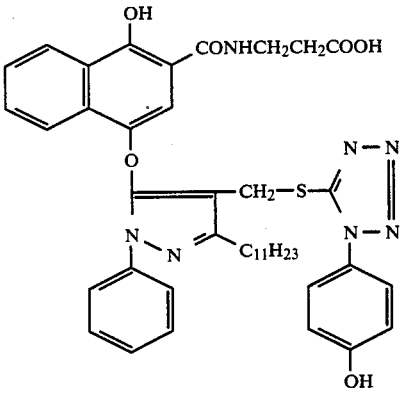
(I-14)
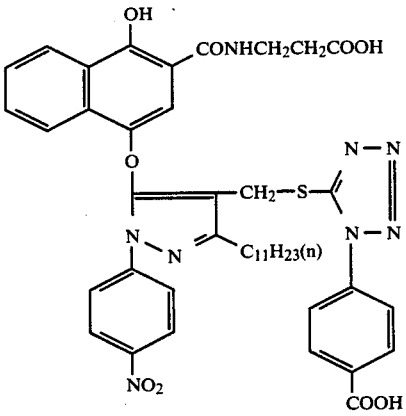

-continued
(I-15)
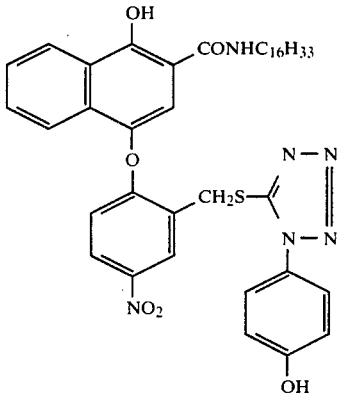
(I-16)
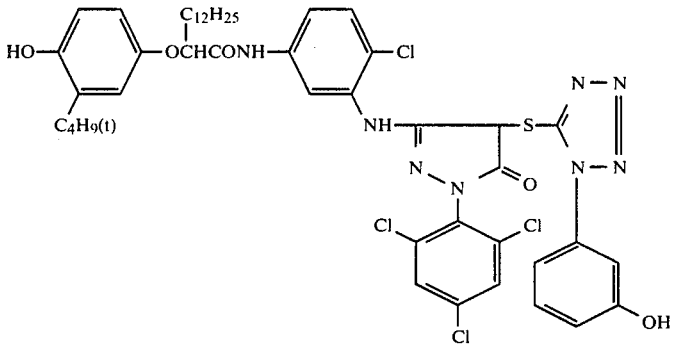
(I-17)
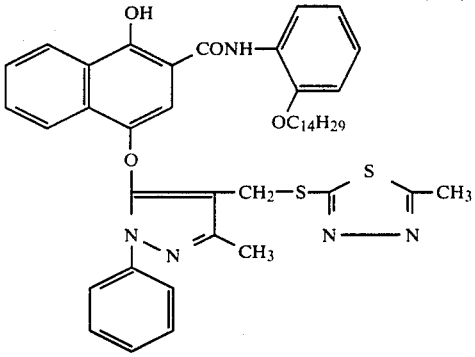
(I-18)
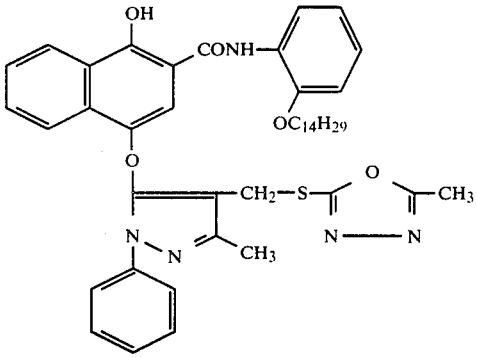
(I-19)
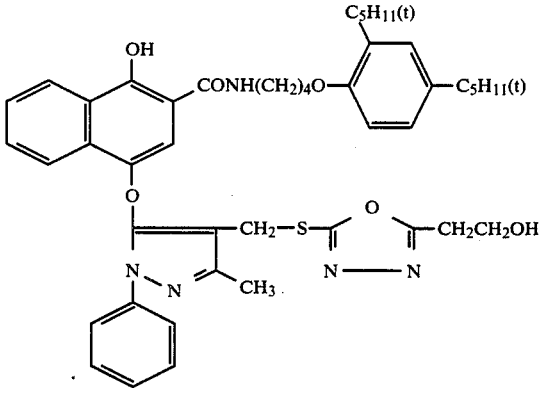
(I-20)
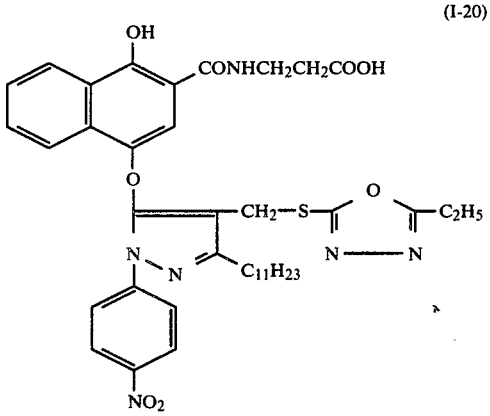
(I-21)
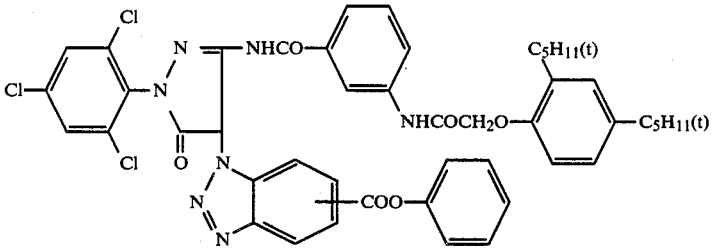
(I-22)
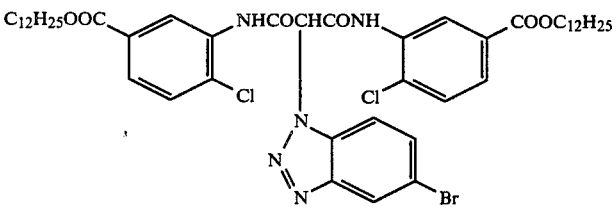

-continued (I-23)

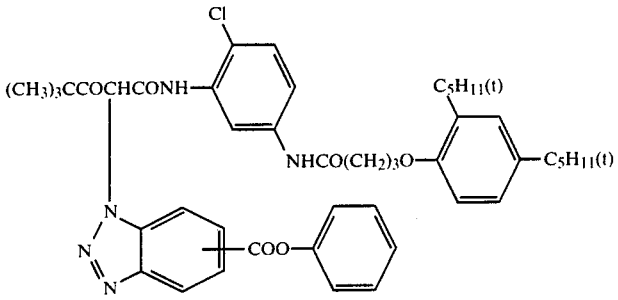

(I-24)

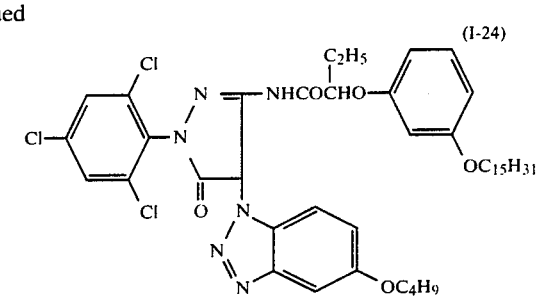

(I-25)

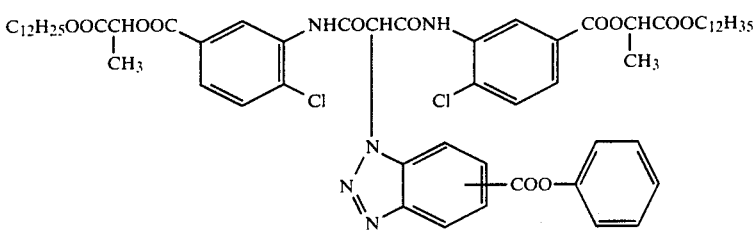

In the light-sensitive material of this invention, the amount of each non-diffusible DIR compound mentioned above is preferably within the range of 0.0001 to 0.01 mole per mole of the silver halide.

In the case in which the emulsion layers comprise two layers consisting of the upper emulsion layer other than the silver halide emulsion layer of this invention and having substantially the same color sensitivity and the lower-side silver halide emulsion layer of this invention, it is preferred to employ, in the upper layer, a DIR compound (hereinafter referred to as the diffusible compound) which can discharge a diffusive development restrainer or a diffusive development restrainer precursor by a coupling reaction, because of enlarging the exposure region of the silver halide emulsion layers of this invention.

The DIR compounds which can discharge the diffusing development restrainers are mentioned in U.S. Pat. No. 4,248,962, Japanese Provisional Patent Publication No. 114946/1981, No. 56837/1982, No. 154234/1982 and No. 217932/1983 and the like, and they can be a compound represented by the following formula [I]:

$$A\text{-}(X)_m \text{ tm[I]}$$

wherein A is a coupling component capable of reacting with an oxidant of a color developing agent such as an undermentioned coupler, m is 1 or 2, and X is a group which is bound to A at a coupling position and which will be eliminated by a reaction with the oxidant of the color developing agent, and after all, X represents a residue of the diffusive development restrainer or a compound residue for eliminating the development restrainer.

Examples of the diffusive development restrainers include mercaptotetrazole, mercaptobenzothiazole, mercaptooxadiazole, mercaptobenzoxazole, mercaptbenzimidazole, benzotriazole and benzodiazole and derivatives thereof. Among them, compounds represented by the following general formulae are preferred:

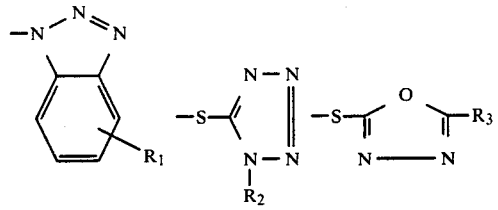

[II] [III] [IV]

In the above formulae, $R_1$ represents a hydrogen atom, a bromine atom, an alkyl group having 1 to 4 carbon atoms (these alkyl groups may be substituted by a methoxy group, an ethoxy group, a hydroxy group or a carboxy group), a nitro group, an amino group, an acylamino group having 3 to 7 carbon atoms, an alkylsunfonamido group having 4 to 8 carbon atoms, an alkoxy group having 2 to 5 carbon atoms, a phenoxycarbonyl group or an alkoxycarbonyl group having 2 to 6 carbon atoms; $R_2$ represents an alkyl group having 1 to 4 carbon atoms (these alkyl groups may be substituted by a methoxy group, an ethoxy group, a hydroxy group or a carboxy group), a hydroxy-substituted phenyl group, an amino group-susbstituted phenyl group, a sulfamoyl-substituted phenyl group or a carboxy-substituted phenyl group; and $R_3$ represents a hydrogen atom, a halogen atom, an amino group, an alkyl group having 1 to 4 carbon atoms (these alkyl groups may be substituted by a methoxy group, an ethoxy group, a hydroxy group or a carboxy group).

Further, the compound residue capable of eliminating the above-mentioned diffusive development restrainer is represented by the following formula [V]:

-TIME-INHIBIT [V]

wherein a TIME group is a group which is bound, at a coupling position, to a coupling component capable of reacting with an oxidant of the color developing agent and which can be cleaved by reacting with the oxidant of the color developing agent, and this TIME group also is a timing group capable of suitably controlling and eliminating the development restrainer after the aforesaid cleavage, and an INHIBIT group is a residue of the development restrainer, and the examples of the INHIBIT groups include the groups enumerated as the group X in the above-mentioned formula [I].

Preferable examples of the TIME groups in the formula [V]include groups represented by the following formulae [VI], [VII] and [VIII]:

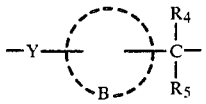

wherein B is an atom group necessary to complete a benzene ring or a naphthalene ring; Y represents —O—,—S—or

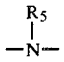

and is bound to an active point of A; and $R_4$, $R_5$ and $R_6$ each are a hydrogen atom, an alkyl group or an aryl group. Further,

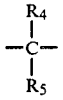

group is substituted by Y at an ortho or a para position and is bound to a hetero-atom contained in the development restraining group.

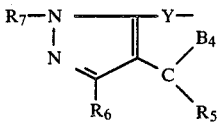

[VII]

wherein Y, $R_4$ and $R_5$ are as defined above regarding the formula [VI], $R_7$ represents a hydrogen atom, an alkyl group, an aryl group, an acyl group, a sulfo group, an alkoxycarbonyl group or a heterocyclic residue, $R_6$ represents a hydrogen atom, an alkyl group, an aryl group, a heterocyclic residue, an alkoxy group, an amino group, an acid amide group, a sulfoamide group, a carboxyl group, an alkoxycarbonyl group, a carbamoyl group or a cyano group.

Further, this timing group is bound to an active point of A with Y as in the formula [VI]and bound to a heteroatom contained in the development restraining group with

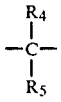

group.

Next, examples of the timing groups for eliminating the development restrainer by an intramolecular nucleophilic substitution reaction are represented by the formula [VIII]:

-Nu-D-E- [VIII]

wherein Nu is a nucleophilic group having an oxygen atom, a sulfur atom or a nitrogen atom rich in electrons and is bound to A at a coupling position, E is an electrophilic group having a carbonyl group, a thiocarbonyl group, a phosphinyl group or a thiophosphinyl group and is bound to a hetero-atom of the development restraining group, and D sterically relates to Nu and E and is a binding group which can break an intramolecular nucleophilic substitution involving a formation of a three-member ring or a seven-member ring thereby capable of releasing the development restraining group.

Next, preferable compounds capable of eliminating the diffusing development restrainer used in this invention will be enumerated, but any limitation should not be made on them.

(D-1)

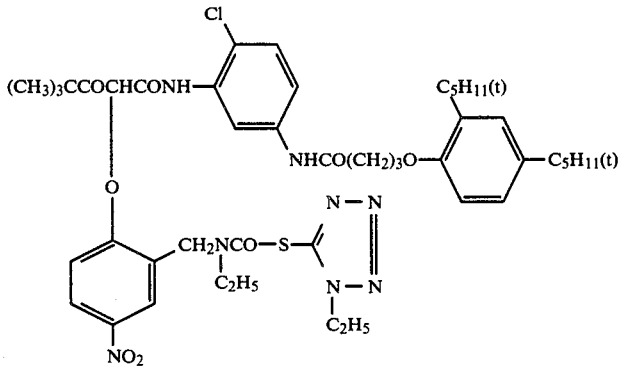

-continued
(D-2)
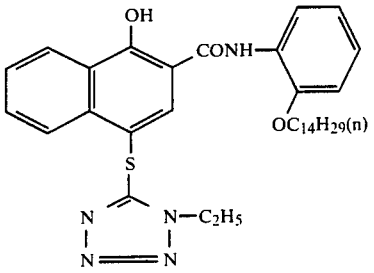
(D-3)
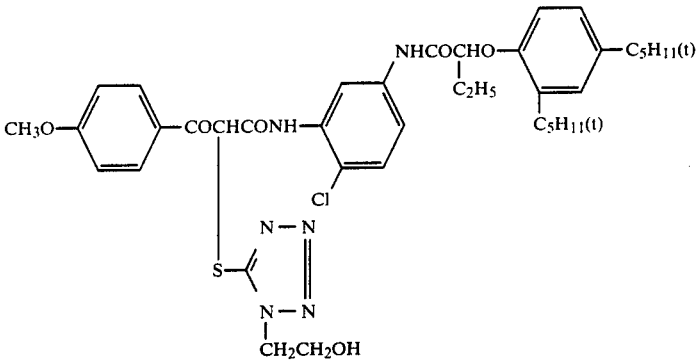
(D-4)
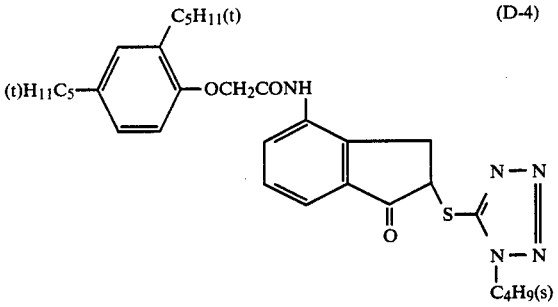
(D-5)
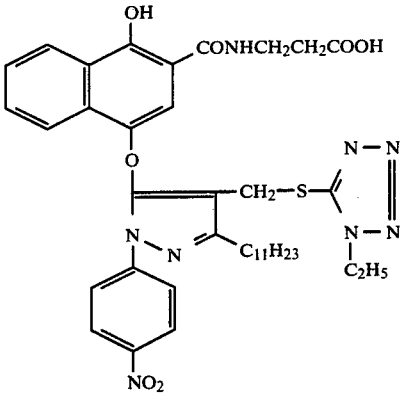
(D-6)
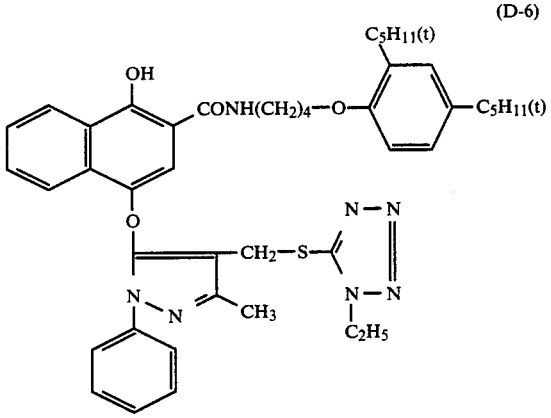
(D-7)
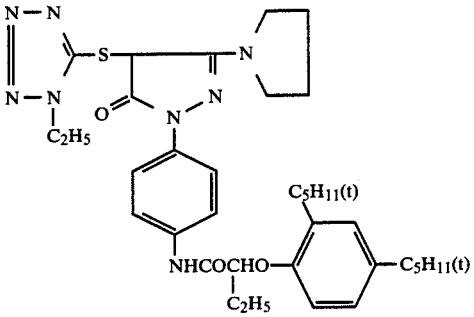

-continued
(D-8)
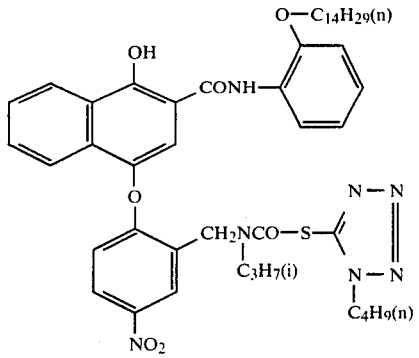
(D-9)
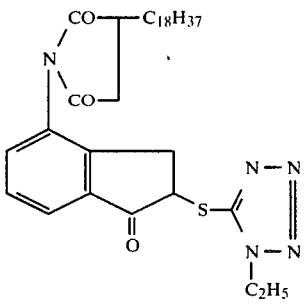
(D-10)
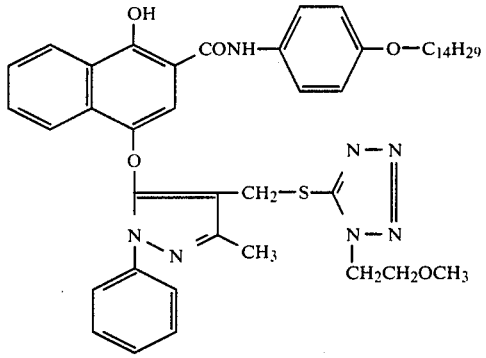
(D-11)
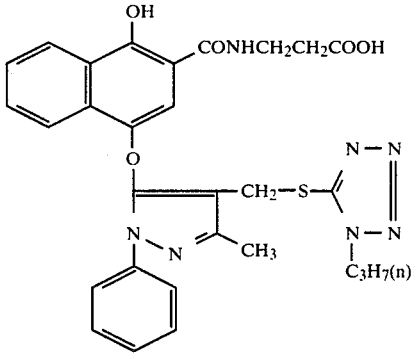
(D-12)
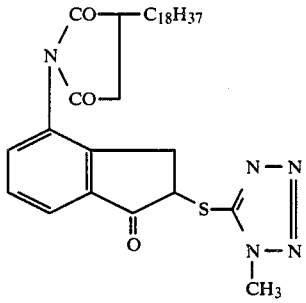
(D-13)
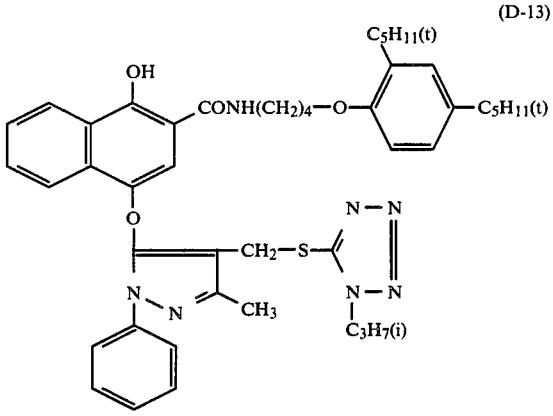
(D-14)
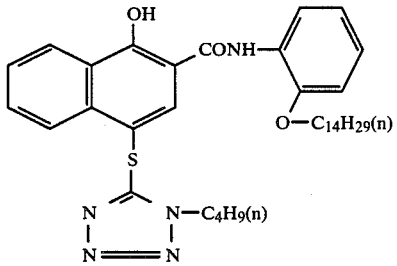
(D-15)
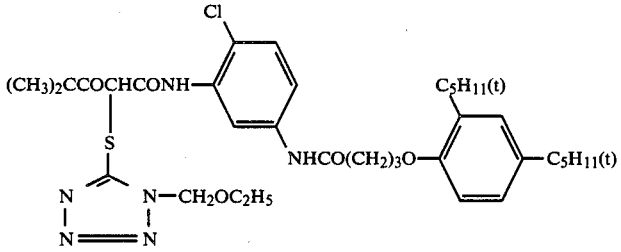

-continued
(D-16)
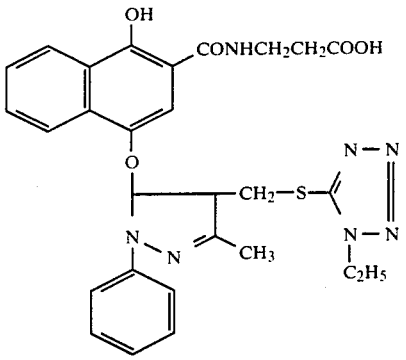
(D-17)
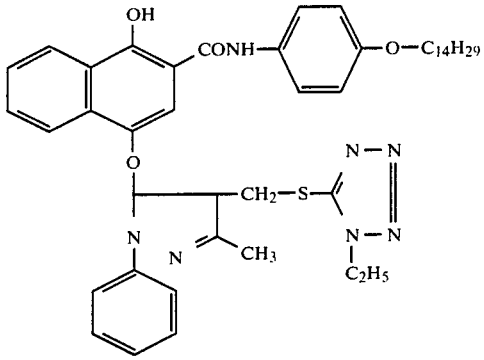
(D-18)
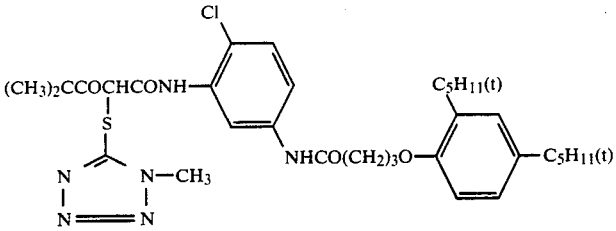
(D-19)
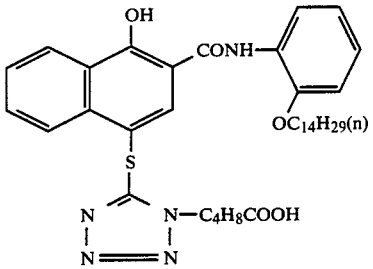
(D-20)
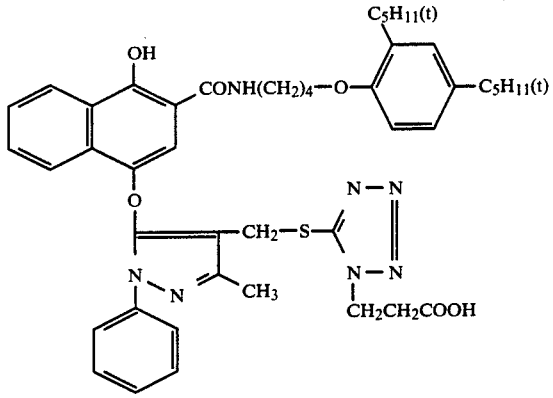
(D-21)
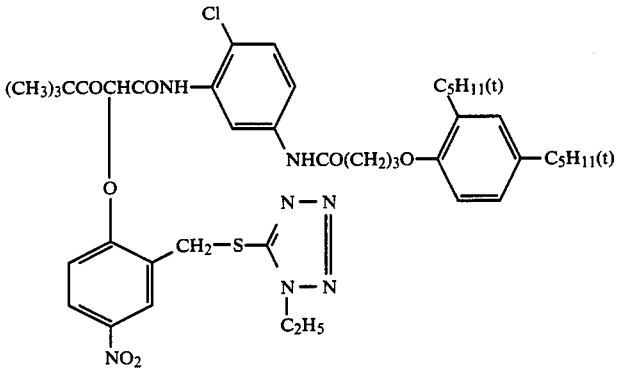

-continued
(D-22)
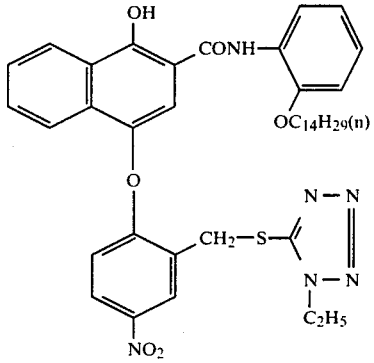
(D-23)
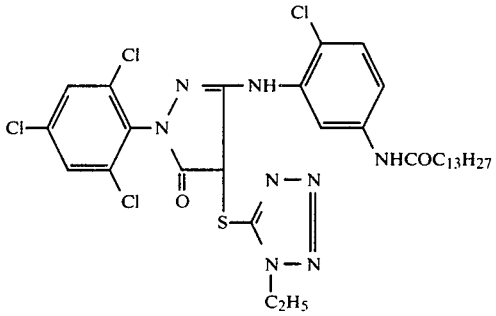
(D-24)
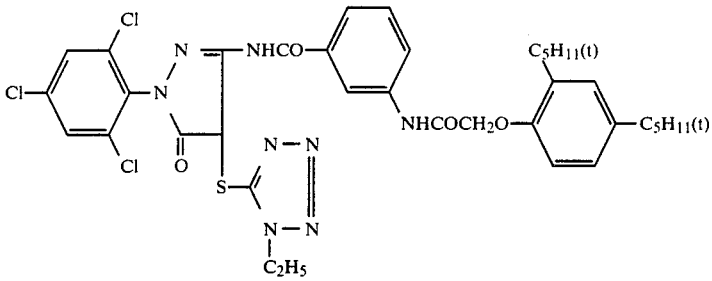
(D-25)
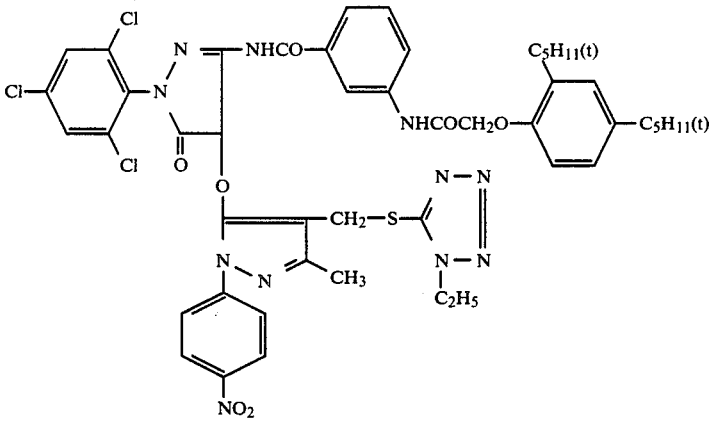
(D-26)
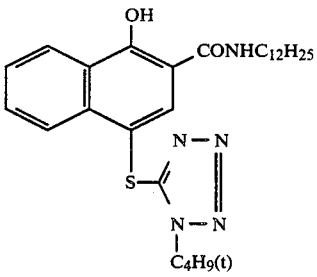
(D-27)
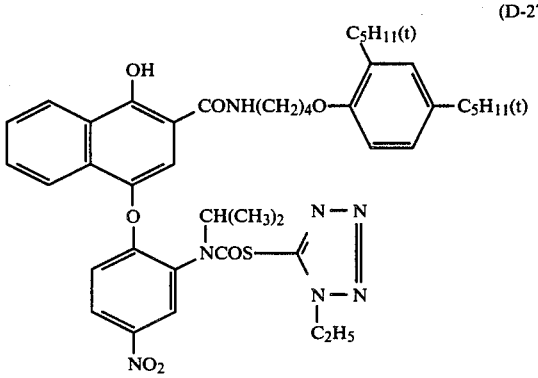

-continued (D-28)

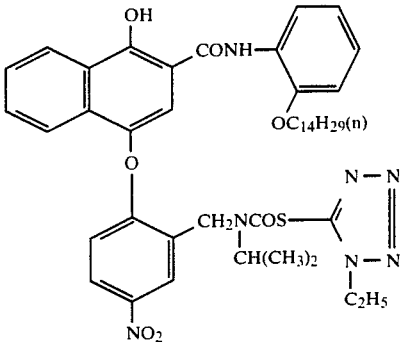

These DIR compounds can be synthesized by methods as disclosed in Japanese Provisional Patent Publications No. 154234/1982 and No. 114946/1981 and U.S. Pat. Nos. 3,227,554, No. 4,234,678, No. 4,149,886, No. 3,933,500 and No. 4,248,962.

In the light-sensitive material of this invention, an amount of the above-mentioned diffusible DIR compound is preferably within the range of 0.0001 to 0.05 mole, more preferably 0.0003 to 0.01 per mole of the silver halide.

The introduction of the DIR compound and undermentioned couplers into the silver halide emulsion layer can be accomplished by any known method, for example, a method disclosed in U.S. Pat. No. 2,322,027. After dissolution in a solvent, for example, a phthalic acid alkyl ester (e.g., dibutyl phthalate, dioctyl phthalate), a phosphoric acid ester (e.g., diphenyl phosphate, triphenyl phosphate, tricresyl phosphate, dioctylbutyl phosphate), a citrate (e.g. tributyl acetyl citrate), a bonzoic acid ester (e.g., octyl benzoate), an alkylamide (e.g., diethyl laurylamide) and the like, or an organic solvent having a boiling point of about 30° C. to 150° C., for example, a lower alkyl acetate such as ethyl acetate and butyl acetate, ethyl propionate, secondary butyl alcohol, methyl isobutyl ketone, β-ethoxyethylethyl acetate, methyl cellosolve acetate and the like, the coupler is dispersed in a hydrophilic colloid. The above-mentioned high-boiling point organic solvent and low-boiling point organic solvent may be used together in a state of a mixture.

If the coupler has an acidic group such as a carboxylic acid or sulfonic acid, it may be introduced into the hydrophilic colloid in a state of an aqueous alkaline solution.

Next, reference will be made to a preferable layer constitution in which this invention is applied to the light-sensitive multi-layer color negative material. In the following layer constitution, B, G and R are a blue-, a green- and a red-sensitive emulsion layer, respectively; H, M and S are a high, a medium and a low sensitivity layer, respectively; D is the diffusible DIR compound; d is a layer containing a non-diffusible DIR compound; m is the silver halide emulsion layer containing the monodispersed silver halide grains of this invention; and I is an intermediate layer.

| Layer Constitution 1 |
|---|
| ↓ Exposure |
| Protective Layer |
| B H D |
| I |
| B S m d |

-continued

| Layer Constitution 1 |
|---|
| ↓ Exposure |
| Protective Layer |
| Yellow Colloid Layer |
| G H D |
| I |
| G S m d |
| I |
| R H D |
| I |
| R S m d |
| Antihalation Layer |
| Base |

| Layer Constitution 2 |
|---|
| ↓ Exposure |
| Protective layer |
| B H D |
| B M m d |
| B S m d |
| Yellow Colloid Layer |
| G H D |
| G M m d |
| G S m d |
| I |
| R H D |
| R M m d |
| R S m d |
| Antihalation Layer |
| Base |

The silver halide emulsion (which includes the emulsion for the silver halide emulsion layer of this invention) used in the light-sensitive material of this invention can accomplish a spectral sensitization with a variety of dyes. Example of usable dye includes a cyanine, a merocyanine, a complex cyanine and a complex merocyanine (i.e., tri-, tetra- and polynucleus cyanine and merocyanine), a polymethine dye including an oxonol, a hemioxonol, a styryl, a merostyryl and a streptocyanine.

As to a cyanine spectral sensitization dye, there may be included two basic heterocyclic nucleus bonded by a methine bonding derived from a quinolinium, a pyridinium, an isopyridinium, a 3H-indolium, an oxazolium, an oxazolinium, a thiazolium, a thiazolinium, a selenazolium, a selenazolinium, an imidazolium, an imidazolinium, a benzoxazolinium, a benzothiazolium, a benzoselenazolium, a benzimidazolium, a naphthoxazolium, a naphtothiazolium, a naphtoselenazolium, a thiazolinium, a dihydronaphthothiazolium, a pyrilium and an imidazopyradinium quaternary salt and the like.

As the merocyanine spectral sensitization dye, there may be included a dye in which an acidic nucleus derived from a barbituric acid, a 2-thiobarbituric acid, a rhodanine, a hydantoin, a 2-thiohydantoin, a 4-thiohydantoin, a 2-pyrazolin-5-one, an indan-1,3-dioxan-4,6-dione, a pyrazolin-3,5-dione, a pentan-2,4-dione, an alkylsulfonylacetnitrile, a malononitrile, an isouqinolin-4-one and a chroman-2,4-dione; and a cyanine dye type basic heterocyclic nucleus are bonded by a methine bonding.

The spectral sensitization dyes useful to sensitize the silver halide emulsion are disclosed in British Pat. No. 742,112, and U.S. Pat. Nos. 1,846,300, 1,846,301, 1,846,302, 1,846,303, 1,846,304, 2,078,233, 2,089,729, 2,165,338, 2,213,238, 2,231,658, 2,493,747, 2,493,748, 2,526,632, 2,739,964 (U.S. Pat. No. Re. 24,292), 2,778,823, 2,917,516, 3,352,857, 3,411,916, 3,431,111, 2,295,276, 2,481,698, 2,503,776, 2,688,545, 2,704,714, 2,921,067, 2,945,763, 3,282,933, 3,397,060, 3,660,102, 3,660,103, 3,335,010, 3,352,680, 3,384,486, 3,397,981, 3,482,978, 3,623,881, 3,718,470 and 4,025,349. Examples of useful dye combinations containing hypersensitization dyes are described in U.S. Pat. Nos. 3,506,443 and 3,672,898. In examples of the hypersensitization combinations comprising the spectral sensitization dyes and light-non-absorbent additives, U.S. Pat. No. 2,221,805 discloses employing a thiocyanate in the process of the spectral sensitization; U.S. Pat. No. 2,933,390 discloses employing bis-triazinylaminostilbene; U.S. Pat. No. 2,937,089 discloses employing sulfonated aromatic compounds; U.S. Pat. No. 3,457,078 teaches the employment of mercapto-substitued complex salt compounds; British Pat. No. 1,413,826 describes the employment of iodides; and Photographic Sci. Eng., Vol. 18, p. 418 (1974) describes the use of specified compounds.

The addition of the above-mentioned sensitizing dye may be carried out at a start of a chemical ripening (which is also called a second ripening), during the progress of the ripening, after the completion of the ripening, or at a suitable time prior to the coating of the emulsion.

Further, the sensitizing dyes may be added to the silver halide emulsion in a variety of manners which have heretofore been suggested. For example, according to a procedure as disclosed in U.S. Pat. No. 3,469,987, the sensitizing dyes are first dissolved in a volatile organic solvent, the resulting solution is then dispersed in a hydrophilic colloid, and this dispersion is added to the emulsion. Furthermore, the sensitizing dyes of this invention may be dissolved respectively in the same solvent or different solvents, and these different solutions may be mixed before their addition to the emulsion or may be added thereto separately and independently.

The preferable solvents for the dyes which are used at the addition of the sensitizing dyes to the silver halide photographic emulsion include, for example, water-miscible organic solvents such as methyl alcohol, ethyl alcohol, acetone and the like.

An amount of the sensitizing dyes to be added to the silver halide emulsion is within the range of $1\times10^{-5}$ to $2.5\times10^{-2}$ mole, preferably $1.0\times10^{-4}$ to $1.0\times10^{-3}$ per mole of the silver halide.

The silver halide grains, inclusive of the monodispersed silver halide grains of this invention, used in the light-sensitive material of this invention can be subjected to various usual chemical sensitization processes. That is, the chemical sensitization can be carried out alone or combined with of an active gelatin; a noble metal sensitizer such as a water soluble gold salt, a water soluble palladium salt, a water soluble rhodium salt or a water soluble iridium salt; a sulfur sensitizer; a selenium sensitizer; a reduction sensitizer such as a polyamine or stannous chloride.

As the above-mentioned sulfur sensitizers, known ones can be used. Examples of such sulfur sensitizers include a thiosulfate, an allylthiocarbamido thiourea, an allylisothiacyanate, a cystine, a p-toluenethiosulfonate, a rhodanine and the like. Other than the above, a sulfur sensitizer as disclosed in U.S. Pat. Nos. 1,574,944, 2,410,689, 2,278,947, 2,728,668, 3,501,313, and 3,656,955; West German Pat. No. 14 22 869; Japanese Patent Publication No. 24937/1981; and Japanese Provisional Patent Publication No. 45016/1980 can be employed. An amount of the sulfur sensitizer to be used must be such that a sensitivity of the emulsion effectively increases. This amount depends largely on conditions such as pH, temperature, size of the silver halide grains and the like, but generally it is within the range of about $10^{-7}$ to about $10^{-1}$ mole per mole of the silver halide.

In place of the sulfur sensitization, the selenium sensitization can be applied, and examples of the selenium sensitizers include an aliphatic isoselenocyanate such as an allylisoselenocyanate; a selenourea; a selenoketone; a selenoamide; a selenocarboxylic acid and ester; a selenophosphate; a selenide such as a diethylselenide, a diethyldiselenide, etc., and concrete examples of these are disclosed in U.S. Pat. Nos. 1,574,944, 1,602,592 and 1,623,499.

An amount of the selenium sensitizer extensively ranges like the sulfur sensitizer, but generally it preferably is from about $10^{-7}$ to $10^{-3}$ mole per mole of the silver halide.

With regard to the gold sensitizers, an oxidation number of gold may be +1 or +3, and thus many gold compounds can be used. Typical examples of the gold sensitizers include a chloroaurate, a potassium chloroaurate, an auric trichloride, a potassium auric thiocyanate, a potassium iodoaurate, a tetracyanoauric acid, an ammonium aurothiocyanate and a pyridyltrichlorogold.

An amount of the gold sensitizer to be used depends on various conditions, but generally it is preferably within the range of about $10^{-7}$ to $10^{-1}$ mole per mole of the silver halide.

In the sensitization method of the silver halide grains of this invention, there can be simultaneously employed another sensitization process by using another noble metal, such as platinum, palladium, iridium or rhodium or salts thereof.

In this invention, the reduction sensitization can also be used together. No limitation is made on reducing agents particularly, and examples of the reducing agents include stannous chloride, thiourea dioxide, a hydrazine derivative, a silane compound and the like.

The reduction sensitization is preferably carried out during a growing period of the silver halide grains, or after the completion of the sulfur sensitization and the gold sensitization.

To the silver halide emulsion used in the light-sensitive material of this invention, a known silver halide solvent may be added at any point of time in the manufacturing process. Examples of the silver halide solvents include (a) an organic thioether as disclosed in U.S. Pat. Nos. 3,271,157, 3,531,289 and 3,574,628, Japanese Provisional Patent Publications No. 1019/1979 and No.

158917/1979 and Japanese Patent Publication No. 30571/1983, 1983; (b) a thiourea as disclosed in Japanese Provisional Patent Publications No. 82408/1978, No. 77737/1980 and No. 29829/1980; (c) an AgX solvent having a thiocarbonyl group sandwitched in between an oxygen atom or a sulfur atom and a nitrogen atom as disclosed in Japanese Provisional Patent Publication No. 144319/1978; (d) an imidazole as disclosed in Japanese Provisional Patent Publication No. 100717/1979; (e) a sulfite; (f) a thiocyanate; (g) ammonia; (h) a hydroxyalkyl-substituted ethylene diamine as disclosed in Japanese Provisional Patent Publication No. 196228/1982; (i) a mercaptotetrazole derivative as disclosed in Japanese Provisional Patent Publication No. 202531/1982; and (j) a benzimidazole derivative as disclosed in Japanese Provisional Patent Publication No. 54333/1983.

To the silver halide emulsion used in the light-sensitive material of this invention, a variety of compounds may be added at the end of the chemical ripening for the purpose of preventing the occurrence of photographic fog during the manufacturing process, storage or development, or for the purpose of stabilizing photographic performances.

Many compounds which are known as, for example, anti-foggants such as an azole, e.g., a benzothiazolium salt, a nitroimdazole, a nitrobenzimidazole, a chlorobenzimidazole, a bromobenzimidazole, a mercaptothiazole, a mercaptobenzimidazole, an aminotriazole, a benzotriazole, a nitrobenzotriazole, a mercaptotetrazole (particularly, 1-phenyl-5-mercaptotetrazole), etc.; a mercaptopyrimidine; a mercaptotriazine; a thioketo compound such as oxazoline thione; and further a benzenethiosulfonic acid amide, benzenesulfinic acid, benzenesulfonic acid amide, a hydroquinone derivative, a aminophenol derivative, a gallic acid derivative, an ascorbic acid derivative and the like; or stabilizers can be added thereto. These agents are preferably added to the emulsion during a chemical ripening or before a coating step.

As binders for the silver halide emulsion used in the light-sensitive material of this invention, a variety of hydrophilic colloids as well as gelatins can be used. The gelatins include a usual photographic gelatin and derived gelatins, and examples of the latter include reaction products of the gelatin and an acid anhydride; the gelatin and an isocyanate; or the gelatin and a compound having an active halogen atom. Examples of the acid anhydrides used for the reactions with the gelatin may include, for example, maleic acid anhydride, phthalic acid anhydride, benzoic acid anhydride, acetic acid anhydride, isatoic acid anhydride, succinic acid anhydride and the like; and examples of the isocyanate compound may include, for example, phenyl isocyanate, p-bromophenyl isocyanate, p-chlorophenyl isocyanate, p-tolyl isocyanate, p-nitrophenyl isocyanate, naphthyl isocyanate and the like.

Further, examples of the compounds having active halogen atoms may include, for example, benzene sulfonyl chloride, p-methoxybenzene sulfonyl chloride, p-phenoxybenzene sulfonyl chloride, p-bromobenzene sulfonyl chloride, p-toluene sulfonyl chloride, m-nitrobenzene sulfonyl chloride, m-sulfobenzoyl dichloride, naphthalene-$\beta$-sulfonyl chloride, p-chlorobenzene sulfonyl chloride, 3-nitro-4-aminobenzene sulfonyl chloride, 2-carboxy-4-bromobenzene sulfonyl chloride, m-carboxybenzene sulfonyl chloride, 2-amino-5-methylbenzene sulfonyl chloride, phthalyl chloride, p-nitrobenzoyl chloride, bonzoylchloride, ethyl cholorocarbonate, furoyl chloride and the like.

As the hydrophilic colloids used to prepare the silver halide emulsion, besides the above-mentioned derivative gelatins and conventional gelatins for photography, there can be used, if desired, colloidal albumin, agar, gum arabic, dextran, alginic acid, cellulose derivatives such as cellulose acetates in which hydrolysis has been accomplished until an acetyl content gets to a level of 19 to 26%, polyacrylamide, imido groups-containing polyacrylamides, casein, vinyl alcohol polymers containing urethane carboxyl groups or a cyanoacetyl groups such as vinyl alcohol-vinyl cyanoacetate copolymer, polyvinyl alcohol-polyvinyl pyrrolidones, hydrolyzed polyvinyl acetates, polymers obtained by polymerization of proteins or acyl saturated proteins with monomers having vinyl groups, polyvinylpyridines, polyvinylamines, polyaminoethyl methacrylates, polyethylene imines and the like.

For various purposes such as coating aid, antistatic, slide improvement, emulsion dispersion, adhesion prevention and improvement of photographic properties (e.g., development acceleration, high contrast and sensitization), a variety of known surface active agents may be included in the silver halide emulsion according to this invention.

Namely, as described in U.S. Pat. Nos. 2,240,472, 2,831,766, 3,158,484, 3,210,191, 3,294,540 and 3,507,660; U.K. Pat. No. 1,012,495, No. 1,022,878, No. 1,179,290 and No. 1,198,450; U.S. Pat. Nos. 2,739,891, 2,823,123, 1,179,290, 1,198,450, 2,739,891, 3,068,101, 3,415,649, 3,666,478 and 3,756,828; U.K. Pat. No. 1,397,218; U.S. Pat. Nos. 2,271,623, 2,288,226, 2,944,900, 3,235,919, 3,671,247, 3,772,021, 3,589,906, 3,666,478 and 3,754,924; West German Patent Application (OLS) No. 19 61 683; Japanese Provisonal Patent Publications No. 117414/1975 and No. 59025/1975; and Japanese Patent Publications No. 378/1965, No. 379/1965 and No. 13822/1968. There can be used nonionic surface active agents, for example, saponin (steroid series), alkyleneoxide derivatives (e.g. polyethylene glycol, condensates of polyethylene glycol/polypropylene glycol, polyethylene glycol alkyl- or alkylaryl-ether polyethylene glycol esters, polyethylene glycol sorbitan esters, polyalkyleneglycol alkylamines or amides, polyethylene oxide additives of silicones), glycidol derivatives (e.g. alkenyl succinic acid polyglyceride, alkylphenol polyglyceride), fatty acid esters of polyvalent alcohols, alkylesters of sugar, urethanes or ethers of the sugar; anionic surface active agents having an acidic group (e.g. a carboxy group, sulfo group, phospho group, sulfuric ester group, phosphoric ester group) such as triterpenoid series saponin, alkylcarboxylic acid salts, alkylnaphthalene sulfonic acid salts, alkylsulfuric esters, alkyl phosphoric esters, N-acyl-N-alkyltaurines, sulfosuccinic acid esters, sulfoalkyl polyoxyethylene alkylphenyl ethers, polyoxyethylene alkylphosphoric acid esters; amphoteric surface active agents such as amino acids, aminoalkyl sulfonic acids, aminoalkylsulfuric acid ester or phosphoric acid esters, alkylbetaines, amineimides and amineoxides; and cationic surface active agents such as alkylamine salts, aliphatic or aromatic quaternary ammonium salts, heterocyclic (e.g. pyridinium, imidazolium) quaternary ammonium salts, and sulfonium compounds containing aliphatic or heterocyclic ring or sulfonium salts.

In the silver halide emulsion according to this invention, they may include, as development accelerators, in addition to the above-mentioned surfactants, imidazoles, thioethers and selenoethers discribed in West German Patent Applications (OLS) No. 20 02 871, No. 24 45 611 and No. 23 60 878; and U.K. Pat. No. 1,352,196.

In the silver halide emulsion according to this invention, usual techniques and materials for the color light-sensitive material can be employed. That is to say, a cyan coupler, a magenta coupler and a yellow coupler are combinedly added to the red-sensitive silver halide emulsion, the green-sensitive silver halide emulsions and the blue-sensitive silver halide emulsion. It is preferred that these couplers have hydrophobic groups called ballast groups and are non-diffusible. Each coupler may be tetraequivalent or diequivalent to a silver ion. Further, a colored coupler having a color correction effect may be used in this invention.

If such a polymer coupler as is described in U.S. Pat. Nos. 3,370,952 and 3,451,820 is employed, the functional effects of this invention can be increased.

As the yellow color-forming couplers, known open chain ketomethylene couplers can be employed. Among them, benzoylacetoanilide and pivaloylacetoanilide series compounds are advantageous. Examples of these usable yellow color-forming couplers are disclosed in U.S. Pat. Nos. 2,875,057, 3,265,506, 3,408,194, 3,551,155, 3,582,322, 3,725,072 and 3,891,445; West German Pat. No. 15 47 868; West German Patent Applications (OLS) No. 22 13 461, No. 22 19 917, No. 22 61 361, No. 24 14 006 and No. 22 63 875.

As the magenta color-forming couplers, there can be employed pyrazolone compounds, indazolone compounds and cyanoacetyl compounds. Particulary, the pyrazolone compounds are advantageous. Examples of the usable megenta color-forming couplers are disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 18 10 464; West German Patent Applications (OLS) No. 24 08 665, No. 24 17 945, No. 24 18 959 and No. 24 24 467; and Japanese Patent Publication No. 6031/1965.

As the cyan color-forming couplers, there can be employed phenol compounds, naphthol compounds and the like. Examples of the cyan color-forming couplers are disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383 and 3,767,411; West German Patent Publications (OLS) No. 24 14 830 and No. 24 54 329; and Japanese Provisional Patent Publication No. 59838/1973.

Examples of the usuable colored couplers are disclosed in, for example, U.S. Pat. Nos. 3,476,560, 2,521,908 and 3,034,892; Japanese Patent Publications No. 2016/1969, No. 22335/1963, No. 11304/1967 and No. 32461/1969; and West German Patent Application (OLS) No. 24 18 959.

In the light-sensitive layer in the light-sensitive material of this invention, a DIR coupler can be further used. Examples of the usuable DIR couplers are disclosed in U.S. Pat. Nos. 3,227,554, 3,617,291, 3,701,783, 3,790,384 and 3,632,345; West German Patent Applications (OLS) No. 24 14 006, No. 24 54 301 and No. 24 54 329; U.K. Pat. No. 953,454; Japanese Provisional Patent Publication No. 154234/1982; Japanese Patent Publication No. 28690/1973; Japanese Provisional Patent Publications No. 145135/1979, No. 151944/1982 and No. 82424/1977; U.S. Pat. Nos. 2,327,554 and 3,958,993; and Japanese Provisional Patent Publication No. 162949/1981.

These couplers are each added to the silver halide emulsion layer usually in an amount of $2\times10^{-3}$ mole to $5\times10^{-1}$ mole, preferably $1\times10^{-2}$ mole to $5\times10^{-1}$ mole per mole of silver.

The light-sensitive material prepared according to the present invention may contain hydroquinone derivatives, aminophenol derivatives, gallic acid derivatives or ascorbic acid derivatives as a color antifoggants, and typical examples of other color antifoggants are disclosed in U.S. Pat. Nos. 2,360,290, 2,336,327, 2,403,721, 2,418,613, 2,675,314, 2,701,197, 2,704,713, 2,728,659, 2,732,300 and 2,735,765; Japanese Provisional Patent Publications No. 92988/1975, No. 92989/1975, No. 93928/1975 and No. 110337/1975; and Japanese Patent Publication No. 23813/1975.

As an antistatic agent, there may be effectively used alkali salts of the reaction product between diacetyl cellulose, styrene-perfluoroalkyllithium maleate copolymer, styrene-manelic anhydride copolymer with p-aminobenzenesulfonic acid. As a matting agent, there may be included polymethylmethacryalte, polystyrene and alkali soluble polymers. Further, colloidal silicon oxide may also be available. As a latex to be added for improvement of film properties, there may be included copolymers of an acrylic acid ester or a vinyl ester with other monomers having other ethylenic groups. As a gelatin plasticizer, there may be employed glycerine or a glycolic compound, while as a thickner, styrene-sodium maleate copolymer, alkylvinylether-maleic acid copolymer, etc. may be employed.

As a support for the light-sensitive silver halide photographic material made from the silver halide emulsion according to this invention as prepared above, there may be mentioned, for example, baryta paper, polyethylene coated paper, polypropylene synthetic paper, glass paper, cellulose acetate, cellulose nitrate, polyvinyl acetal, polypropylene, polyester film such as polyethyleneterephthalate, polystyrene, etc., and these supports may be suitably selected depending on the respective intended use of the light-sensitive silver halide photographic material.

These supports may be applied with a subbing treatment, if desired.

The light-sensitive color material of this invention can be subjected to a color development in accordance with a usual color development method after exposure.

According to a reversal process, the light-sensitive material is first developed with a black negative developing solution, and a white exposure is then given thereto, or the material is treated with a bath containing a fogging agent and afterward with an alkaline developing solution containing a color developing agent. Particular restrictions are not put on processing methods, and any processing can be applied. As the typical applicable methods, there are, for example, a method comprising color development and bleach-fix processing, and if necessary, further washing and stabilization; a method comprising color development, bleach and subsequently fixing, and if necessary, further washing and stabilization; and a non-washing method comprising color development and bleach-fix processing without washing.

This invention can be suitably applied to many light-sensitive color materials. For example, it can be effectively applied to the light-sensitive materials, e.g., for color negatives, infrared films, microfilms, reversal films, diffusion transfer processes and the like, but more preferably, it is applicable to light-sensitive color photographic materials for photographing.

EXAMPLES

Now, this invention will be described in detail in reference to examples, but it is not to be limited by them.

[Preparation of polydispersed emulsion]

An aqueous silver nitrate solution and an aqueous alkalihalide solution were placed, by gravity-drop, in a reaction vessel a temperature of which was maintained at 60° C. and in which an aqueous gelatin solution and an exessive halide had previously been put, and precipitation and desalting were then carried out by adding an aqueous Demol N (trade name) solution made by Kao Atlas Co., Ltd. and an aqueous magnesium sulfate solution. Subsequently, gelatin was added thereto in order to prepare an emulsion having pAg 7.8 and pH 6.0. A chemical ripening was then carried out using sodium thiosulfate, chloroauric acid and Rhodan ammonium, and 4-hydroxy-6-methyl-1,3,3a,7-tetrazaindene and 6-nitrobenzimidazole were then added thereto. Further, gelatin was added thereto, whereby polydispersed silver iodobromide emulsions A and B were prepared. In this case, the mole % value of silver iodide was varied by changing a composition of the alkali-halide and the average grain diameter and the grain distribution were varied by changing an addition time of the aqueous silver nitrate solution and the aqueous alkali-halide solution.

[Preparation of monodispersed emulsion]

An aqueous ammoniacal silver nitrate solution and an aqueous potassium iodide/potassium bromide solution were placed in a reaction vessel in which seed grains of a silver halide and an aqueous gelatin solution had previously been put, in proportion to an increase in surface area at a grain growing period, while the pAg and the pH of a mixture in the reaction vessel were controlled. Next, precipitation and desalting were then carried out by adding an aqueous Demol N (trade name) solution made by Kao Atlas Co., Ltd. and an aqueous magnesium sulfate solution. Subsequently, gelatin was added thereto in order to prepare an emulsion having pAg 7.8 and pH 6.0. A chemical ripening was then carried out using sodium thiosulfate, chloroauric acid and Rhodan ammonium, and 4-hydroxy-6-methyl-1,3,3a,7-tetrazaindene and 6-nitrobenzimidazole were then added thereto. Further, gelatin was added thereto, whereby monodispersed silver iodobromide emulsions C to I were prepared. In this case, the mol % value of silver iodide was varied by changing the ratio of potassium iodide to potassium bromide, the grain diameter was varied by changing amounts of the ammoniacal silver nitrate and the potassium halides, and the crystal habit was varied by changing the pAg values in the reaction.

A core/shell emulsion was prepared in accordance with a method described in Japanese Provisional Patent Publication No. 48521/1979.

Physical properties of the respective silver iodobromide emulsions thus prepared are set forth with numerical values in Table 1 below.

As a criterion for indicating an extent of a light-sensitive section, a linear exposure scale (hereinafter referred to as L.E.S.) was employed which was described in T. H. James, "The Theory of the Photographic Process", 4th edition, pp. 501 and 502. Sensitivities were represented by relative values of reciprocal numbers of exposures for providing a fog density of +0.1.

Further, each graininess was represented by a value 1,000 times as much as standard deviations of a variation of a concentration value (RMS) obtained when a dye image having color image concentrations of 0.4 and 1.0 was scanned by a microdensitometer having a circular scanning aperture of 25 82 m.

EXAMPLE 1

On a transparent support comprising an undercoated cellulose triacetate film, the following layers were disposed in turn to prepare Sample I. In all the examples described hereinafter, amounts of components to be added to light-sensitive materials were expressed by values per square meter, and amounts of silver halide emulsions and colloidal silver were expressed by values in terms of silver.

[Sample I]

Layer 1 . . . an antihalation layer containing 0.4 g of black colloidal silver and 3 g of gelatin.

Layer 2 . . . A low sensitivity red-sensitive emulsion layer containing 2.0 g of a low red-sensitive silver iodobromide emulsion (Table 1), 2.0 g of gelatin, 1 g of 2-(4-n-butylsulfonylphenylureido)-5-[α-(2,4-di-t-amylphenoxy)butanamido]-phenyl (hereinafter referred to as C - 1), 0.60 g of 1-hydroxy-4-[4-(1-hydroxy-δ-acetoamido-3,6-disulfo-2-naphthylazo)-phenoxy]-N-[δ-(2,4-di-t-amylphenoxy)butyl]-2-naphthoamide disodium (hereinafter referred to as CC - 1) and 0.5 g of butyl phthalate (hereinafter referred to as DBP) in which a DIR compound in Table 2 was dissolved.

Layer 3 . . . An intermediate layer containing 1.0 g of gelatin.

Layer 4 . . . A high sensitivity red-sensitive emulsion layer containing 1.5 g of a high sensitivity red-sensitive iodobromide silver (Table 1), 1.5 g of gelatin, 0.05 g of 1-hydroxy-4-(β-methoxyethylaminocarbonylmethoxy)-N-[δ-(2,4-di-t-aminophenoxy)-butyl]-2-naphthoamide (hereinafter referred to as C - 2), 0.075 g of a colored coupler CC - 1, 1.00 g of 1-hydroxy-2-[δ-(2,4-di-t-amylphenoxy)-n-butyl]-naphthoamide (hereinafter referred to as C - 3) and 0.8 g of tricresyl phosphate (hereinafter referred to as TCP) in which a DIR compound shown in Table 2 was dissolved.

Layer 5 . . . A protective layer containing 2.3 g of gelatin.

Emulsions (No. A to H) set forth in Table 1 and DIR compounds in Table 2 were used in the same manner as in the case of the above-mentioned sample in order to prepare Samples Nos. 1 to 9 in which amounts of C - 2 and C - 3 for Layer 4 were 4/5 and 3/5 of the above-mentioned weights, respectively (in samples containing less amounts thereof in Layer 4, an amount of Layer 2 was increased, so that a maximum color concentration was maintained at the same level).

A red exposure was provided for these samples through an optical wedge, and they were then treated in the following processing steps to form a dye image. The obtained specific values are set forth in Table 3.

| Processing steps [Processing temperature 38° C.] | Processing Time |
|---|---|
| Color development | 3 min. 15 sec. (standard condition) |

-continued

| Processing steps [Processing temperature 38° C.] | Processing Time |
|---|---|
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

Compositions of processing solutions used in the respective processing steps were as follows:

| [Composition of color developing solution] | |
|---|---|
| 4-Amino-3-methyl-N—ethyl-N—(β-hydroxyethyl)-aniline.sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid.trisodium salt (monohydrate) | 2.5 g |
| Potassium hydroxide | 1.0 g |

(made up to one liter with addition of water and adjusted to pH=10.0 with potassium hydroxide or sulfuric acid)

| [Composition of bleaching solution] | |
|---|---|
| Ferric ammonium ethylenediamine-tetraacetate | 100.0 g |
| Diammonium ethylenediaminetetraacetate | 10.0 g |
| Ammonium bromide | 150.0 g |
| Glacial acetic acid | 10.0 ml |

(made up to one liter with addition of water and adjusted to pH 6.0 with aqueous ammonia)

| [Composition of fixing solution] | |
|---|---|
| Ammonium thiosulfate | 175.0 g |
| Anhydrous sodium sulfite | 8.6 g |
| Sodium metasulfite | 2.3 g |

(made up to one liter with addition of water and adjusted to pH 6.0 with acetic acid)

| [Composition of stabilizing solution] | |
|---|---|
| Formalin (37% aqueous solution) | 1.5 ml |
| Konidax (Trade name, produced by Konishiroku Photo Industry, Co., Ltd.) | 7.5 g |

(made up to one liter with addition of water).

TABLE I

| Emulsion No. | Average grain diameter ($\bar{r}$) (μm) | Proportion of silver halide grains contained within the range of $\bar{r} \pm 20\%$ (wt %) | Content of silver iodide in core (mole %) | Content of silver iodide in shell (mole %) | Thickness of shell (μm) |
|---|---|---|---|---|---|
| A | 1.20 | 40 | — | — | — |
| B | 0.580 | 45 | — | — | — |
| C | 0.250 | 51 | — | — | — |
| D | 0.400 | 85 | 10 | 2 | 0.08 |
| E | 0.500 | 90 | 9 | 2 | 0.09 |
| F | 0.550 | 93 | 8 | 2 | 0.10 |
| G | 1.08 (Twinned crystal) | 60 | 8 | 1 | 0.12 |
| H | 0.850 | 80 | 6 | 0.5 | 0.15 |

TABLE 2

| | Layer 2 | | Layer 4 | | | | | | RMS | | | Allotment* |
|---|---|---|---|---|---|---|---|---|---|---|---|---|
| No. | AgX | DIR Compound | C-2, C-3 | AgX | DIR Compound | Fog | Sensitivity | Gamma | 0.4 | 1.0 | L.E.S. | of Lower Layer |
| 1 | B + C (5 = 5) | I-6 0.03 g | 5/5 | A | — | 0.13 | 100 | 0.70 | 40 | 35 | 2.5 | 58% |
| 2 | B + C (5 = 5) | I-10 0.04 g | 4/5 | G | D-6 0.05 g | 0.12 | 105 | 0.65 | 37 | 35 | 2.4 | 66% |
| 3 | D | I-7 0.05 g | 5/5 | H | D-5 0.05 g | 0.12 | 110 | 0.66 | 35 | 28 | 2.4 | 58% |
| 4 | D | I-7 0.06 g | 4/5 | H | — | 0.12 | 110 | 0.67 | 31 | 25 | 2.6 | 66% |
| 5 | D | I-7 0.06 g | 4/5 | H | D-5 0.05 g | 0.11 | 105 | 0.64 | 30 | 25 | 2.5 | 66% |
| 6 | E | I-7 0.05 g | 3/5 | H | D - 5 0.04 g | 0.10 | 103 | 0.65 | 25 | 26 | 2.5 | 75% |
| 7 | F | I-7 0.07 g | 2/5 | H | D-5 0.04 g | 0.10 | 100 | 0.66 | 23 | 27 | 2.4 | 83% |
| 8 | E | I-10 0.05 g | 3/5 | A | D-17 0.05 g | 0.10 | 98 | 0.62 | 28 | 25 | 2.5 | 75% |
| 9 | E | I-6 0.06 g | 3/5 | G | D-6 0.06 g | 0.09 | 106 | 0.67 | 20 | 26 | 2.4 | 75% |

*The allotment of the lower layer means a proportion of a color concentration in the lower layer of the same color-sensitive layers (this is to be applied hereinafter) and is a value measured by the method as described on page 11, line 3 to page 13, line 4 of the present specification.

As is apparent from Table 2, the samples of this invention were more excellent in graininess and exposure range as compared with Comparative Examples Nos. 1, 2 and 3. Further, the effects of this invention could be obtained even when the silver halide of upper layers was composed of twinned crystals and monodispersed emulsions.

EXAMPLE 2

On Layer 4 of each sample prepared in Example 1, the following layers were further provided (amounts of couplers in upper layers were varied in accordance with selected emulsions and DIR compounds as in Example 1, and allotments in lower layers in such cases were also varied).

Layer 5 . . . An intermediate layer containing 1 g of gelatin.

Layer 6 . . . A green-sensitive emulsion layer containing 1.4 g of each emulsion (Table 3) which had been color-sensitized so as to be rendered green-sensitive, 2.2 g of gelatin, 0.8 g of a following magenta coupler (M - 1), 0.15 g of 1(2,4,6-trichlorophenyl)-4-(1-naphthylazo)-3-(2-chloro-5-octadecenylsuccinimidoanilio)-5-pyrazolone (hereinafter referred to as CM - 1) and 0.95 g of TCP in which each DIR compound in Table 3 was dissolved.

M-1

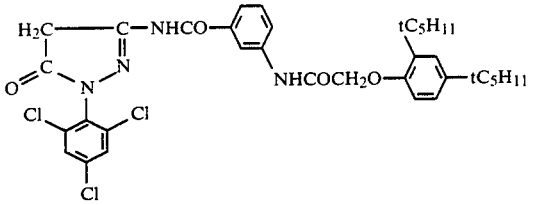

Layer 7 . . . This layer was the same as Layer 3 in Example 1.

Layer 8 . . . A high green-sensitive emulsion layer containing 1.5 g of a high sensitivity green-sensitive silver iodobromide emulsion (Table 3), 1.2 g of gelatin, 0.1 g of M - 1, 0.45 g of CM - 1 and 0.35 g of TCP in which each DIR compound in Table 3 was dissolved.

Layer 9 . . . A yellow filter layer containing 0.15 g of yellow colloidal silver, 0.2 g of a stain preventive (HQ-1) and 0.5 g of gelatin.

Layer 10 . . . A low sensitivity blue-sensitive emulsion layer containing 0.5 g of a low sensitivity blue-sensitive silver iodobromide emulsion (Table 3), 1.6 g of gelatin, 1.4 g of yellow coupler Y - 1 and 0.14 g of TCP in which each DIR compound in Table 3 was dissolved.

Y-1

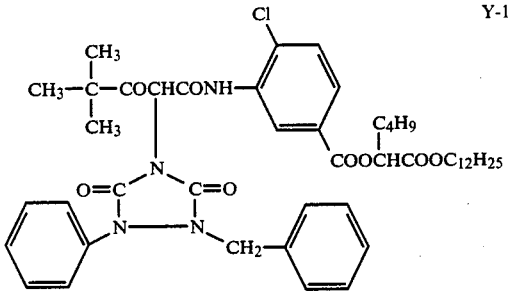

Layer 11 . . . A high sensitivity blue-sensitive emulsion containing 0.6 g of high sensitivity blue-sensitive silver iodobromide emulsion (Table 3), 0.8 g of gelatin, 0.46 g of the above-mentioned yellow coupler Y - 1 and 0.1 g of TCP in which each DIR compound in Table 3 was dissolved.

Layer 12 . . . A protective layer containing 1.2 g of gelatin and a matting agent having a grain diameter of 2 μm and a composition comprising methyl methacrylate:ethyl methacrylate:methyl acrylate being 3:3:4 (monomer molar ratio).

In the same manner as in the above-mentioned Sample No. 10, Samples Nos. 11 to 13 were prepared in combinations of emulsions in Table 3.

For these samples, exposure and development were carried out in the same manner as in Example 1 to measure characteristic values.

The results are set forth in Table 4.

TABLE 3

| | No. | 10 | 11 | 12 | 13 |
|---|---|---|---|---|---|
| Layer 2 | AgX | B + C (5 = 5) | D | D | E |
| | DIR compound | I-6 0.03 g | I-7 0.03 g | I-7 0.05 g | I-10 0.04 g |
| Layer 4 | Coupler | 3/5 | 5/5 | 3/5 | 2/5 |
| | AgX | A | H | H | G |
| | DIR compound | — | D-6 0.04 g | D-6 0.06 g | D-17 0.05 g |
| Layer 6 | AgX | B + C (5 = 5) | D | E | E |
| | DIR compound | I-7 0.05 g | I-7 0.04 g | I-6 0.05 g | I-6 0.04 g |
| Layer 8 | Coupler | 3/5 | 5/5 | 3/5 | 3/5 |
| | AgX | A | H | H | H |
| | DIR compound | — | D-5 0.04 g | D-6 0.06 g | D-5 0.05 g |
| Layer 10 | AgX | B + C (4 = 6) | E | E | F |
| | DIR compound | I-6 0.06 g | I-6 0.06 g | I-7 0.05 g | I-10 0.05 g |
| Layer 11 | Coupler | 3/5 | 5/5 | 4/5 | 3/5 |
| | AgX | A | H | H | G |
| | DIR compound | — | D-5 0.05 g | D-5 0.04 g | D-5 0.04 g |

TABLE 4

| | | | Other than this invention | | This invention | |
|---|---|---|---|---|---|---|
| | | | 10 | 11 | 12 | 13 |
| Cyan color-forming layer | Sensitivity | | 100 | 110 | 100 | 105 |
| | Gamma | | 0.60 | 0.58 | 0.58 | 0.56 |
| | RMS | 0.4 | 37 | 40 | 25 | 20 |
| | | 1.0 | 35 | 30 | 25 | 23 |
| | LES | | 2.4 | 2.2 | 2.4 | 2.6 |
| | Allotment of lower layer* | | 75% | 58% | 75% | 83% |
| Magenta color-forming layer | Sensitivity | | 100 | 115 | 98 | 110 |
| | Gamma | | 0.70 | 0.65 | 0.64 | 0.63 |
| | RMS | 0.4 | 40 | 42 | 26 | 24 |
| | | 1.0 | 36 | 32 | 25 | 24 |
| | LES | | 2.3 | 2.1 | 2.4 | 2.4 |
| | Allotment of lower layer* | | 75% | 58% | 75% | 75% |
| Yellow color-forming layer | Sensitivity | | 100 | 106 | 105 | 115 |
| | Gamma | | 0.75 | 0.70 | 0.68 | 0.70 |
| | RMS | 0.4 | 44 | 44 | 35 | 30 |
| | | 1.0 | 38 | 39 | 30 | 28 |
| | LES | | 2.5 | 2.3 | 2.6 | 2.5 |
| | Allotment of lower layer* | | 75% | 58% | 66% | 75% |

*Allotment of lower layer is a value measured by the method as described on page 11, line 3 to page 13, line 4 of the present specification.

As is apparent from Table 4, the samples of this invention had sensitivity and gamma at the same level as in comparative samples, and with regard to graininess and exposure range, the samples of this invention were more excellent than the comparative samples.

The employment of the monodispersed silver halide grains, which are associated with the technique of this invention, and the increase in a concentration of the above grains in the layers permit the improvement of graininess, the enlargment of exposure range and better of stability to processing and stability with time. In consequence, it can be believed that the silver halide grains of this invention contribute to the advancement of the general technique of the emulsions and thus the above-mentioned objects of this invention can be accomplished.

We claim:

1. a light-sensitive silver halide color photographic material comprising a support and a plurality of silver halide emulsion layers on said support, said emulsion layers being substantially identical in color sensitivity but different in sensitivity and containing at least one dye image-forming coupler, characterized in that silver halide grains contained in at least one layer of said plurality of silver halide emulsion layers consist essentially of monodispersed silver halide grains which contain iodine and which are core/shell type grains comprising at least two zones which have different silver iodide contents, the iodide content in the core being within the range of 6 to 30 mole %, the color concentration of said emulsion layer comprising said monodispersed silver halide grains being within the range of 60 to 98% of the total color concentration of said plurality of silver halide emulsion layers, wherein said at least one emulsion layer is a layer of lower sensitivity and said silver halide grains in said layer of lower sensitivity are of one type.

2. A light-sensitive silver halide color photographic material according to claim 1, wherein said color concentration in the silver halide emulsion layers is within the range of 70 to 95% of the total concentration in the same color-sensitive layers.

3. A light-sensitive silver halide color photographic material according to claim 2, wherein said color concentration in the silver halide emulsion layers is within the range of 80 to 90% of the total concentration in the same color-sensitive layers.

4. A light-sensitive silver halide color photographic material according to claim 1, wherein said monodispersed silver halide grain is grains in which the weight of the silver halide grains each having an average diameter $\bar{r}$ and diameters within the range of ±20% of the average diameter $\bar{r}$ occupies at least 60% of the total weight of silver halide grains, where said average diameter $\bar{r}$ is a grain diameter $r_i$ at the time when a product $n_i \times r_i^3$ of a frequency $n_i$ of the grains each having the grain diameter $r_i$ and $r_i^3$ is at a maximum level.

5. A light-sensitive silver halide color photographic material according to claim 4, wherein said weight of the silver halide grains having the diameter of the $\bar{r}$ and the diameters within the range of ±20% of the diameter $\bar{r}$ occupies at least 70% of the total weight of the grains.

6. A light-sensitive silver halide color photographic material according to claim 5, wherein said weight of the silver halide grains having the diameter of the $\bar{r}$ and the diameters within the range of ±20% of the diameter $\bar{r}$ occupies at least 80% of the total weight of the grains.

7. A light-sensitive silver halide color photographic material according to claim 6, wherein said weight of the silver halide grains having the diameter of the $\bar{r}$ and the diameters within the range of ±20% of the diameter $\bar{r}$ occupies at least 90% of the total weight of the grains.

8. A light-sensitive silver, halide color photographic material according to claim 1, wherein an average diameter of said silver halide grain is from 0.2 to 3 μm.

9. A light-sensitive silver halide color photographic material according to claim 9, wherein an average diameter of said silver halide grain is from 0.3 to 0.7 μm.

10. A light-sensitive silver halide color photographic material according to claim 1, wherein a thickness of shell is within the range of 0.01 to 0.15 μm.

11. A light-sensitive silver halide color photographic material according to claim 1, wherein a color concentration in a highest sensitivity layer is within the range of 2 to 40% of the total color concentration of the layers having the same color sensitivity.

12. A light-sensitive silver halide color photographic material according to claim 11, wherein a color concentration in a highest sensitivity layer is within the range of 2 to 30% of the total color concentration of the layers having the same color sensitivity.

13. A light-sensitive silver halide color photographic material according to claim 1, wherein said material has the following layer structure:

(1) protective layer
(2) high blue-sensitive silver halide emulsion layer with diffusible DIR compound
(3) intermediate layer
(4) low blue-sensitive silver halide emulsion layer with monodispersed silver halide grains and diffusible DIR compound
(5) yellow colloid layer
(6) high green-sensitive silver halide emulsion layer with diffusible DIR compound
(7) intermediate layer
(8) low green-sensitive silver halide emulsion layer with monodispersed silver halide grains and diffusible DIR compound
(9) intermediate layer
(10) high red-sensitive silver halide emulsion layer with diffusible DIR compound
(11) intermediate layer
(12) low red-sensitive silver halide emulsion layer with monodispersed silver halide grains and diffusible DIR compound
(13) antihalation layer
(14) base support.

14. A light-sensitive silver halide color photographic material according to claim 1, wherein said material has the following layer structure:

(1) protective layer
(2) high blue-sensitive silver halide emulsion layer with diffusible DIR compound
(3) medium blue-sensitive silver halide emulsion layer with monodispersed silver halide grains and diffusible DIR compound
(4) low blue-sensitive silver halide emulsion layer with monodispersed silver halide grains and diffusible DIR compound
(5) yellow colloid layer
(6) high green-sensitive silver halide emulsion layer with diffusible DIR compound
(7) medium green-sensitive silver halide emulsion layer with mnodispersed silver halide grains and diffusible DIR compound
(8) low green-sensitive silver halide emulsion layer with monodispersed silver halide grains and diffusible DIR compound
(9) intermediate layer

(10) high red-sensitive silver halide emulsion layer with diffusible DIR compound
(11) medium red-sensitive silver halide emulsion layer with monodispersed silver halide grains and diffusible DIR compound
(12) low red-sensitive silver halide emulsion layer with monodispersed silver halide grains and diffusible DIR compound
(13) antihalation layer
(14) base support.

* * * * *